United States Patent [19]

Silberstein

[11] 4,393,885

[45] Jul. 19, 1983

[54] CIGARETTE FILTER

[75] Inventor: Donald A. Silberstein, Louisville, Ky.

[73] Assignee: Brown & Williamson Tobacco Corporation, Louisville, Ky.

[21] Appl. No.: 303,756

[22] Filed: Sep. 21, 1981

[51] Int. Cl.[3] ..... A24D 3/04

[52] U.S. Cl. ..... 131/339; 131/216

[58] Field of Search ..... 131/338, 339, 340, 341, 131/342, 343, 336, 216, 331

[56] References Cited

FOREIGN PATENT DOCUMENTS 736743 6/1966 United Kingdom ..... 131/339

1115485 5/1968 United Kingdom ..... 131/339

1436636 5/1976 United Kingdom ..... 131/339

*Primary Examiner*—V. Millin

*Attorney, Agent, or Firm*—Charles G. Lamb

[57] ABSTRACT

A filter for a cigarette has a porous filter rod with a channel extending longitudinally through the filter rod. The end of the channel at the tobacco column of the cigarette is closed by a smoke impervious wall having an orifice therein of a smaller cross-sectional area than the cross-sectional area of the channel to provide flow communication between the tobacco column and the channel. The filter rod can be circumscribed with an air pervious tipping material.

8 Claims, 4 Drawing Figures

CIGARETTE FILTER

BACKGROUND OF THE INVENTION

The present invention relates to filters for cigarettes. In one aspect it relates to a cigarette filter providing at least one flow path for cigarette smoke and another flow path for ambient ventilating air to the mouth end of the filter. In another aspect the present invention relates to a cigarette filter with a flow restriction in the at least one smoke flow path to create a pressure drop to increase the draw resistance therethrough.

DESCRIPTION OF THE PRIOR ART

It is well known in the art of filter cigarettes to provide filters with ventilating air means to dilute the smoke stream. The dilution of the smoke stream reduces the quantity of smoke particulates as well as gas phase components delivered to the mouth of the smoker. A number of means have been proposed and are utilized for introducing ventilating air into the cigarette. For example, the wrapper for the tobacco in a cigarette can be made of a porous material which allows for the introduction of air along the entire length of the cigarette where it mixes with the smoke stream passing therethrough, thereby diluting the smoke in the stream prior to entering the smoker's mouth. In another example, the cigarette wrapper may be perforated at selected locations along the length of the cigarette which provides ports through which ventilating air enters the cigarette to mix with the smoke stream. It is also known to wrap the cigarette filter with a porous filter wrap to allow ventilating air to enter the filter to dilute the smoke stream flowing through the cigarette filter before entering the smoker's mouth. Alternatively, the cigarette filter wrap can be perforated to allow ventilating air to enter the filter to dilute the smoke flowing through the filter. Furthermore, in the introduction of ventilating air into the filter to dilute the smoke therein, circular discs with small orifices have been utilized at the junction of the filter and the tobacco column to accelerate the smoke leaving the tobacco column, examples being noted in U.S. Pat. No. 2,954,778 and U.S. Pat. No. 3,395,713.

SUMMARY OF THE INVENTION

The present invention advantageously provides a straightforward arrangement of a filter for a cigarette which in one aspect provides a pressure drop approaching that of more conventional cigarettes. In a further aspect, the present invention provides a cigarette filter for lowering tar predominantly by mixing tabacco smoke with ambient ventilation air instead of filtration.

More particularly, the present invention provides a filter for a cigarette comprising a first longitudinally extending cylindrical chamber; a second longitudinally extending cylindrical chamber disposed within the first chamber with a spacing between the outer wall of the second chamber and the inner wall of the first chamber, the wall of the second chamber being air impervious; transversely disposed smoke impervious partition means at the end of the chambers interfacing with a tobacco column of the cigarette; and, means defining at least one orifice through the smoke impervious partition means to provide flow communication between the tobacco column of the cigarette and the second chamber, the orifice having a smaller cross-sectional area than the cross-sectional area of the second chamber.

The above-discussed features and other features of the present invention will become obvious to those skilled in the art upon reading the disclosure set forth hereinafter.

BRIEF DESCRIPTION OF THE DRAWINGS

A better understanding of the present invention will be had upon reading the following specification and by reference to the accompanying drawings, in which like numerals refer to like parts throughout the several figures and wherein.

DESCRIPTION OF THE PREFERRED EMBODIMENT

Figure 1:
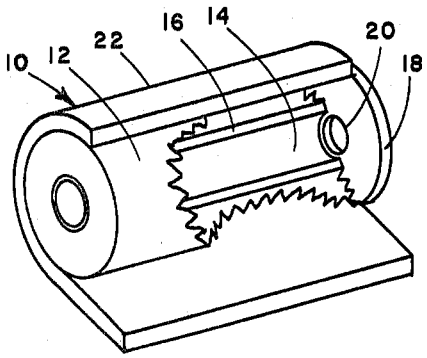
FIG. 1 is a perspective view, partially cross-sectioned, of a cigarette filter embodying various features of the present invention.
Figure 3:
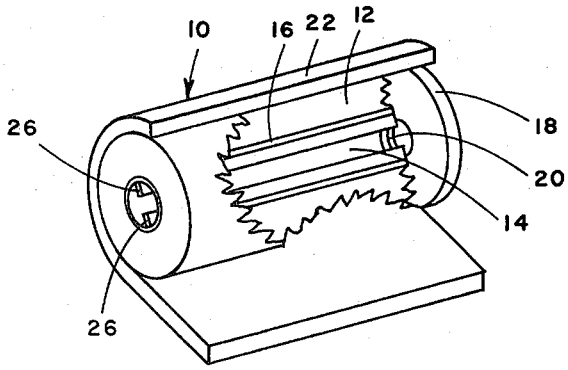
FIG. 3 is a perspective view, partially cross-sectioned, of another advantageous embodiment of a cigarette filter embodying various features of the present invention; and, FIG. 4 is a longitudinal cross-sectioned view of a cigarette having the filter of FIG. 3.

With reference to FIGS. 1 and 3, there is illustrated a cigarette filter 10 of the present invention. The cigarette filter comprises a porous filter rod 12 having a cylindrical configuration. The filter rod is fabricated of fibrous or foamed material such as, for example, cellulose acetate. A chamber or channel 14 extends longitudinally through the filter rod 12 from one end to the other end thereof. The channel 14 is shown as being defined by a hollow tube 16 coaxially disposed within the filter rod 12. The tube 16 is fabricated of smoke and air impermeable material and has a smaller cross-sectional area than the tobacco column with which it is to be used. The end of the filter rod 12 to be disposed at the tobacco column is impervious to smoke. As shown, this is accomplished by transversely disposing a gas impervious partition 18 at the end of the filter rod 12 which is to interface with the tobacco column. The gas impervious partition is formed with at least one orifice 20 to provide flow communication between the tobacco column of the cigarette and the channel 14 in the filter rod. As illustrated, the at least one orifice 20 is shown as being coaxial with the hollow tube 16, but is smaller in cross-sectional area than the transverse cross-sectional area of the tube 16 defining the chamber or channel 14. The cigarette filter rod 12 can be circumscribed with an air pervious tipping material 22, the tipping paper defining a first cylindrical chamber encompassing the filter rod 12 and the second chamber 14. The tipping material can be, for example, fabricated of a porous material or can be perforated at selected positions to provide for the flow of air therethrough. However, means for defining the first cylindrical chamber may be a plastic sleeve, or the like, and the filter rod 12 may be omitted from the annular space between the plastic sleeve, or the like, and the hollow tube 16 without departing from the scope and spirit of the present invention. Also, filter material may be inserted within the tube 16 to facilitate filtration of smoke as it travels through the tube 16. It is also contemplated that the tipping material can be fabricated of an air impervious material.

Figure 2:
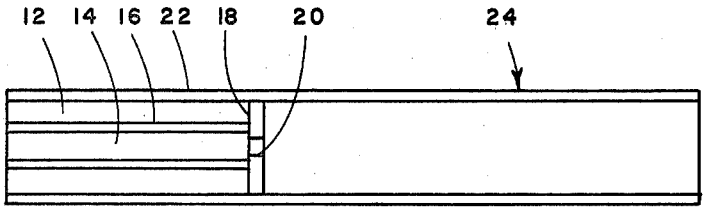
FIG. 2 is a longitudinal cross-sectioned view of a cigarette having the filter of FIG. 1.
Figure 4:
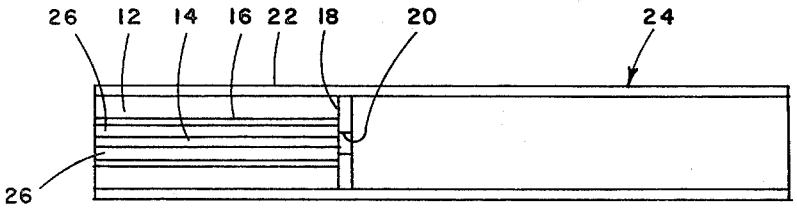

In the use of the filter 10 of the present invention as shown in FIGS. 2 and 4, tobacco smoke from the tobacco column 24 passes through the orifice 20 and travels through the flow path defined by the channel 14 and out of the channel 14 through its open end at the opposite end of the filter rod 12 from the tobacco column 24. Ambient ventilating air is drawn through the filter rod 12 and moves, in a separate flow path from that flow path of the smoke, longitudinally of the filter rod 12 in the interstice of the filter rod in the first chamber to the mouth end of the filter 10. The ventilating air and tobacco smoke commingle outside the mouth end of the filter 10 whereupon the tobacco smoke is diluted while maintaining the flavor of the tobacco smoke.

The orifice 20 is appropriately sized with respect to the transverse cross-sectional area of the channel 14 to provide any desired pressure drop there-across from the tobacco column 24 to the channel 14. The orifice can be advantageously sized to provide a pressure drop to create a draw effort of a more conventional cigarette. Furthermore, when the orifice is appropriately sized as the cigarette is smoked particulate material in the tobacco smoke will accumulate on the wall of the orifice 20 gradually diminishing the size of the orifice with the advantageous result that the draw effort or resistance will gradually increase and, thus, gradually increase the amount of ambient ventilating air being drawn through the filter rod 12. Therefore, the particulate matter delivery is more constant per puff during the smoking process as compared to more conventional filter cigarettes.

FIGS. 3 and 4 illustrate the filter 10 further comprising means for adding surface area to the wall of the channel 14 to collect particulate material from the smoke, thereby increasing the amount of particulate material separated from the tobacco smoke as the cigarette is smoked. This added surface area means comprises projections such as, for example, hair-like projections, or as illustrated, a plurality of spaced apart fins 26 extending generally radially inwardly of the channel 14 from the wall of the hollow tube 16. The fins 26 are illustrated as extending the entire length of the channel 14 and are shown to be of a depth generally equal to the radial distance between the wall of the hollow tube 16 and the perimeter of the orifice 20. However, it is contemplated that the fins could, for example, extend only part way along the length of the channel 14 and extend across the entire diameter of the hollow tube.

It should be kept in mind that the various advantageous results can be altered to suit particular requirements by using different filter rod materials, filter tip wrapping material and changing the relative sizes of the orifice and hollow tube.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A filter for a cigarette, comprising:

a first longitudinally extending cylindrical chamber;

a second longitudinally extending cylindrical chamber disposed within the first chamber with a spacing between the outer wall of the second chamber and the inner wall of the first chamber, the wall of the second chamber being air impervious;

transversely disposed smoke impervious partition means disposed at the end of the chambers interfacing with a tobacco column of the cigarette; and, means defining at least one orifice through said smoke impervious partition means for providing direct flow communication between the tobacco column of the cigarette and the interior of said second chamber whereby no smoke comes in contact with the exterior of said second chamber, the at least one orifice having a smaller cross-sectional area than the cross-sectional area of the second chamber, said first and second chambers being of substantially the same length with their ends being transversely aligned.

2. The filter of claim 1, wherein said second chamber is defined by a hollow tube fabricated of gas impervious material.

3. The filter of claim 1, wherein said second chamber and said orifice are coaxially disposed.

4. The filter of claim 1 including a porous filter rod in the annulus defined by the spacing between the walls of the first and second chamber.

5. The filter of claim 4, further comprising an air impervious tipping paper circumscribing said porous filter rod defining said first chamber.

6. The filter of claim 4, further comprising an air pervious tipping paper circumscribing said porous filter rod defining said first chamber.

7. The filter of claim 1, further comprising means adding surface area of said second chamber for collecting particulate matter from the tobacco smoke flowing through said channel means.

8. The filter of claim 7, wherein said means adding surface area comprises a plurality of projections extending into said second chamber.

* * * * *